US006186815B1

(12) United States Patent
Lin

(10) Patent No.: US 6,186,815 B1
(45) Date of Patent: Feb. 13, 2001

(54) ZERO INSERTION FORCE SOCKET

(75) Inventor: Nick Lin, Hsin-Chuang (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/303,099

(22) Filed: Apr. 29, 1999

(30) Foreign Application Priority Data

Dec. 11, 1998 (TW) ..... 87220689

(51) Int. Cl.[7] ..... H01R 13/625
(52) U.S. Cl. ..... 439/342; 439/924.1
(58) Field of Search ..... 439/342, 924.1, 439/259

(56) References Cited

U.S. PATENT DOCUMENTS 5,380,997 * 1/1995 Hania et al. ..... 439/325
5,649,836 * 7/1997 Kashiwagi ..... 439/342

* cited by examiner

*Primary Examiner*—Neil Abrams
*Assistant Examiner*—Javaid Nasri
(74) *Attorney, Agent, or Firm*—Wei Te Chung

(57) ABSTRACT

A zero insertion force (ZIF) socket for electrically connecting an electronic package and a mother board, comprises an insulative cover, a driving device, an insulative base defining a number of engaging slots therein and at least two types of engaging terminals received in the corresponding engaging slots. The engaging terminals or rows of the engaging slots are each offset relative to each other. Thus, electrical contacts are established between the engaging terminals and conductive terminals of the electronic package at different times thereby effectively lowering the operating resistance of the ZIF socket.

5 Claims, 5 Drawing Sheets

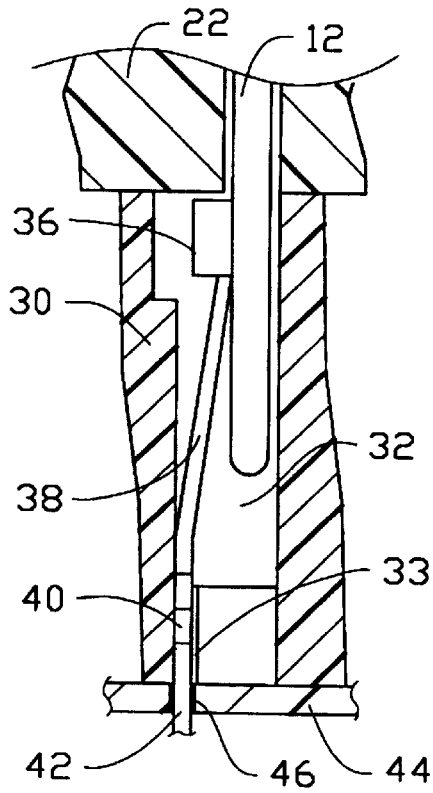
FIG. 3
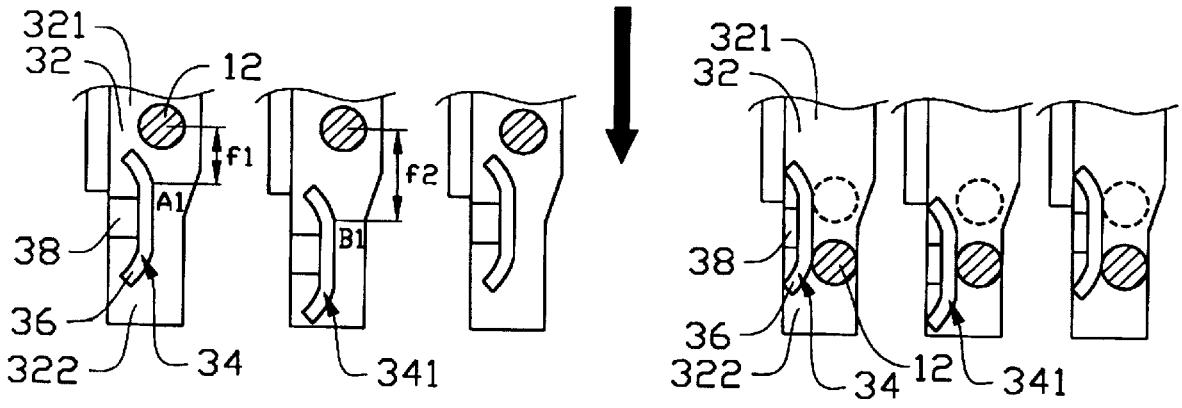
FIG. 4A
FIG. 4B

ZERO INSERTION FORCE SOCKET

BACKGROUND OF THE INVENTION

The present invention relates to an electrical socket for electrically connecting a electronic package and a mother board, and particularly to a zero insertion force (ZIF) electrical socket which can lower the operating resistance of the ZIF socket.

A conventional socket of the prior arts for electrically engaging with a electronic package having a large number of terminals should be equipped with auxiliary features for facilitating the mating process. For example, a cam lever can be introduced for simplifying opening and closing operations. In addition, engaging terminals of the ZIF socket can be configured to reduce a normal contact force between the engaging terminals of the ZIF socket and conductive contacts of a mating electronic package. However, large operating resistance is still not properly addressed by sockets of the prior art. Large contact normal peak force between engaging terminals of the electronic package and conductive terminals of a mating socket must be overcome at the onset of operation. Furthermore, unstable or inaccurate contact may result between terminals of an electronic package and a socket during assembly.

BRIEF SUMMARY OF THE INVENTION

A main object of the present invention is to provide a socket exhibiting the advantages of a low peak operating resistance and a reliable electrical connecting performance thereby ensuring mating quality.

In accordance with one aspect of the present invention, adjacent groups of engaging terminals received in corresponding engaging slots of a socket are arranged to be offset relative to each other. Thus, the engaging terminals of the socket contact with corresponding conductive terminals of a mating electronic package at different times thereby lowering operating resistance of the socket for moving from an inoperative position to an operative position by activating a lever from a vertical position to a horizontal position during assembly.

In accordance with another aspect of the present invention, rows of engaging slots receiving the corresponding engaging terminals of the socket are arranged to be offset relative to each other for electrically engaging the conductive terminals of the electronic package at different times.

Other objects, advantages and novel features of the invention will become more apparent from the following detailed description when taken in conjunction with the accompanying drawings.

BRIEF DESCRIPTION OF THE SEVERAL VIEWS OF THE DRAWING

FIG. 3 is a partial cross sectional view of the socket of the present invention showing the assembly of a mating terminal with the electronic package and a mother board;

FIG. 4A is a cross sectional view of a first embodiment of the present invention showing three engaging terminals before engagement with the corresponding conductive terminals of the electronic package;

FIG. 4B is similar to FIG. 4A showing the engaging terminals engaged with the corresponding conductive terminals of the electronic package;

DETAILED DESCRIPTION OF THE PREFERRED EMBODIMENTS

Figure 1:
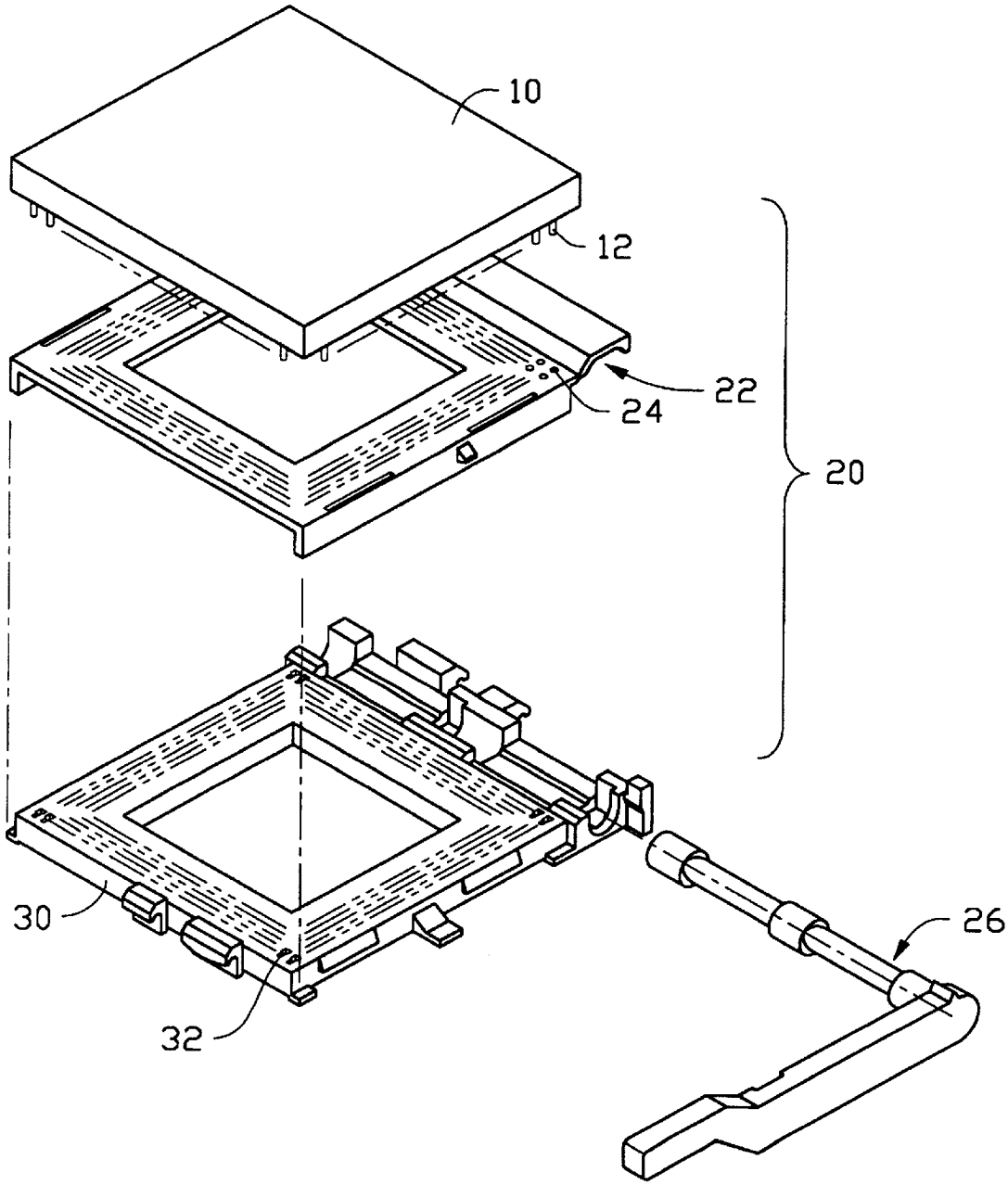
FIG. 1 is an exploded view of a socket of the present invention and an electronic package having conductive terminals arranged in arrays.
Figure 2:
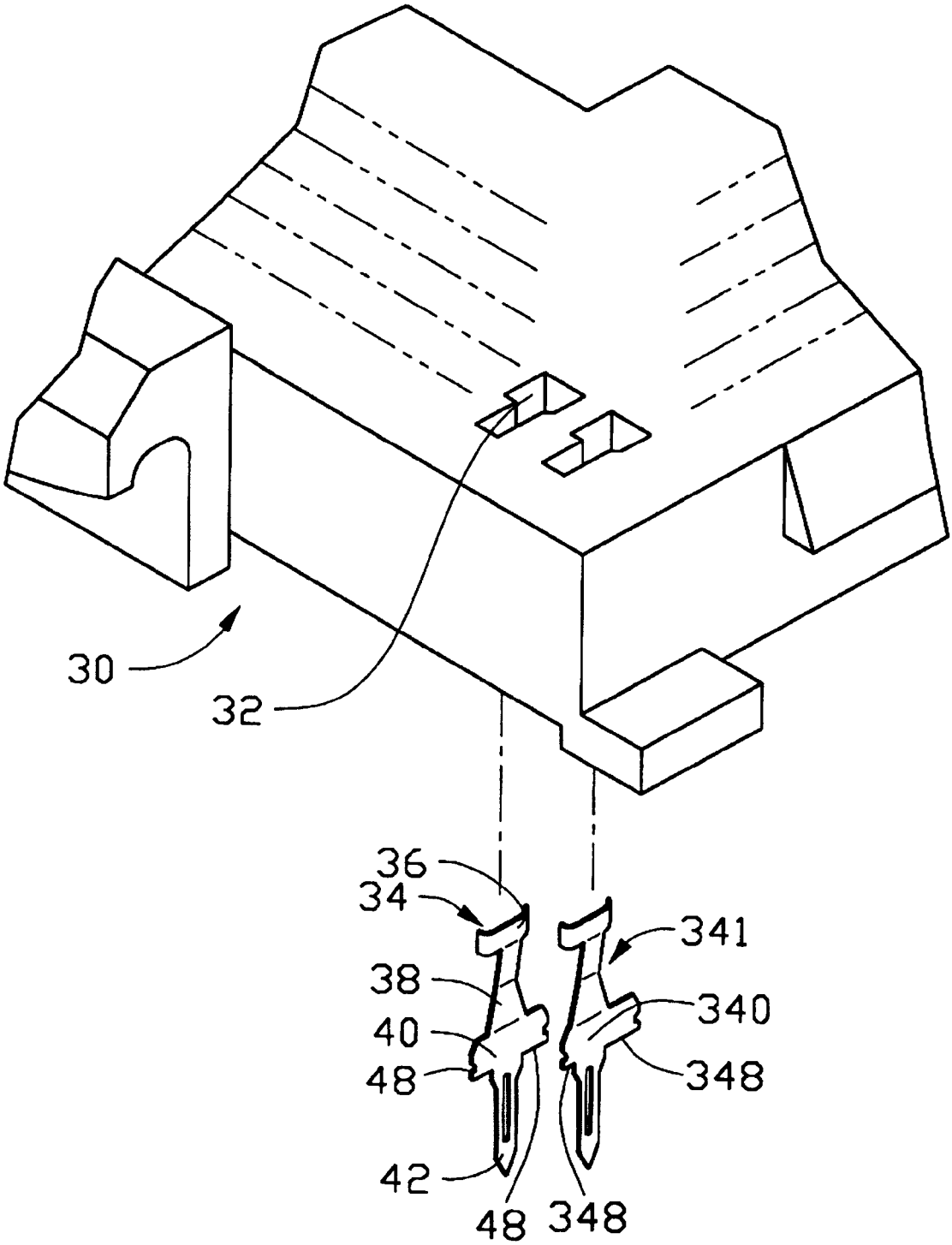
FIG. 2 is a partial perspective view of the socket of the present invention and engaging terminals thereof.

Referring to FIGS. 1 and 2, an electronic package 10 is provided with rows of conductive terminals 12. An electrical socket 20 forms a plurality of terminal receiving passageways 24 in an insulative cover 22 thereof and a plurality of engaging slots 32 in an insulative base 30 thereof. The conductive terminals 12 are insertable through the terminal receiving passageways 24 of the cover 22 into the engaging slots 32 of the insulative base 30 and each engaging slot 32 is relevant to a corresponding terminal receiving passageway 24 inserted through by the same conductive terminal 12. First engaging terminals 34 and second engaging terminals 341 are received in the engaging slots 32. An L-shaped lever 26 is pivotally attached between the cover 22 and the base 30 thereby driving the cover 22 relatively sliding along a top mating surface of the base 30, thus enabling the conductive terminals 12 of the package 10 moving in the engaging slots 32 of the socket 20.

Further referring to FIG. 3, each engaging slot 32 of the base 30 has a wide opening 321 communicating with a narrow opening 322. Each engaging terminal of the first engaging terminals 34 and the second engaging terminals 341 comprises a contact section 36 for contacting the corresponding conductive terminal 12 of the electronic package 10, a supporting section 38 extending from the contact section 36, a securing section 40 for interferentially fitting in the corresponding engaging slot 32 and a mating lead 42 extending from the securing section 40, through an aperture 33 and beyond a bottom surface of the base 30 to be received in a corresponding mating slot 46 of a mother board 44. The difference between the first engaging terminals 34 and the second engaging terminals 341 lies in the structure of the securing sections 40, 340. Two limbs 48 of the securing section 40 of the first engaging terminal 34 are the same length, while two limbs 348 of the securing section 340 of the second engaging terminal 341 are different lengths. However, the total length of each securing section 40, 340 is the same for each engaging terminal 34, 341.

The conductive terminals 12 of the electronic package 10 extend through the terminal receiving passageways 24 of the cover 22 into the engaging slots 32 of the base 30 thereby electrically contacting with the engaging terminals 34, 341. Since the mating leads 42 of the engaging terminals 34, 341 are electrically connected with the mother board 44, the terminals 12 are also electrically connected therewith.

A detailed description of the three embodiments of the present invention is given below. Three engaging terminals 34, 341 received in the corresponding engaging slots 32 are used to describe the mating process with the conductive terminals 12.

Figure 5A:
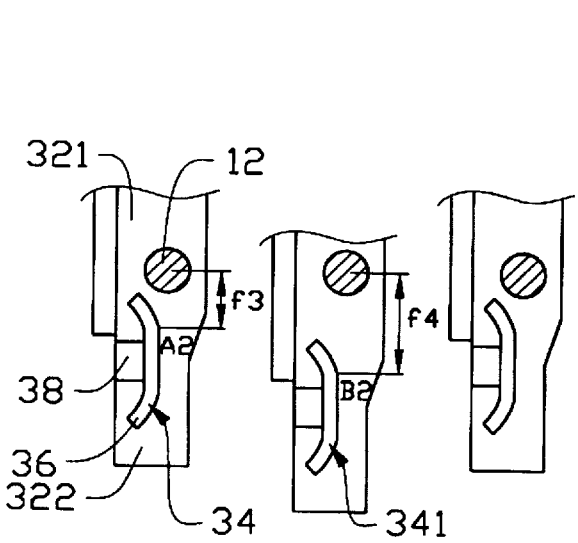
FIG. 5A is a cross sectional view of a second embodiment of the present invention showing three engaging terminals before engagement with the corresponding conductive terminals of the electronic package.
Figure 6A:
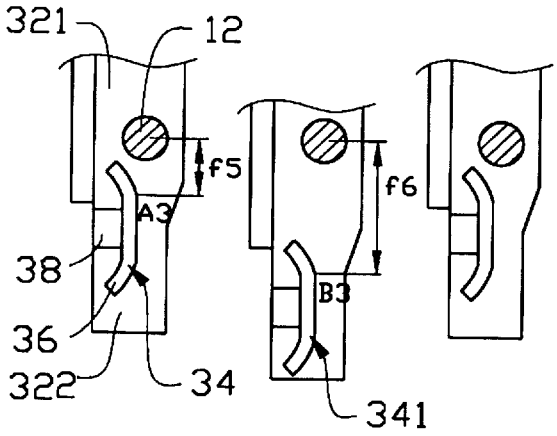
FIG. 6A is a cross sectional view of a third embodiment of the present invention showing three engaging terminals before engagement with the corresponding conductive terminals of the electronic package.

Referring to FIGS. 4A and 4B, in the first embodiment, the engaging terminals 34, 341 are alternately disposed in the same row of the engaging slots 32. When the conductive terminals 12 of the electronic package 10 are in inoperative positions, that is, being received in the wide openings 321 of the corresponding engaging slots 32 of the base 30, electrical contact is not yet established with the engaging terminals 34, 341. Please refer to FIG. 4A, particularly, the contact sections 36 of the first and the second engaging terminals 34, 341 respectively have a first contact point A1 and a first contact point B1 that contact foremost corresponding conductive terminals 12 of the electrical package 10. In the inoperative positions, the first points A1, B1 of the contact sections of the first engaging terminals 34 are offset respectively a first distance f1 and a second distance f2 from the same row of conductive terminals 12 of the electrical package 10 in a first sliding direction (shown by large arrows in FIGS. 4A, 5A & 6A) defined by relative movement between the base 30 and the cover 22. The second distance J2 is greater than the first distance f1. It is well know in the ZIF Socket field that each conductive terminal 12 of the electrical package 10 is relevant to the engaging slot 24 of the cover 22 in which the conductive terminal 12 is received. Thus, the first and the second engaging terminals 34, 341 are disposed in the engaging slots 24 in such a manner that the first contact points A1, B1 of the contact sections of the first and the second engaging terminals 34, 341 are respectively offset the distances f1, f2 relative to center lines of the engaging slots 24 relevant to the engaging slots 32 in which the first and the second engaging terminals 34, 341 are received. Similar features are shown in FIGS. 5A & 6A and symbols f3~f6 are used to facilitate understanding of such features. When the lever 26 is activated from a vertical position to a horizontal position to drive the cover 22 sliding along a top surface of the base 30 in the first sliding direction, the conductive terminals 12 are displaced from the wide openings 321 of the engaging slots 32 to the narrow openings 322 of the engaging slots 32 thereby contacting the corresponding contact sections 36 of one of the engaging terminals 34, 341. The supporting sections 38 of the engaging terminals 34 are thus deformed toward a wall of the corresponding mating slots 32. The conductive terminals 12 firmly abut against a middle or end portion of the contact sections 36 thereby being distanced from the wide opening 321 of the mating slots 32, that is to say, the socket 20 is in an operative position. Therefore, electrical contacts between the conductive terminals 12 of the electronic package 10 and the engaging terminals 34, 341 occurs at different times by alternately arranging the first engaging terminals 34 to be offset relative to the second engaging terminals 341 in the corresponding engaging slots 32 along the first sliding direction. Thus, the operating resistance of the socket 20 is effectively dispersed by creating intervals of contact during the mating process.

As best seen in FIGS. 4A & 4B, the conductive terminals 12 of the electronic package 10 are disposed in rows and the conductive terminals in a same row are not offset relative to each other in the first sliding direction (shown by large arrow). The rows of engaging slots 32 are arranged in the first sliding direction and each row extends in a second direction being generally perpendicular to said first sliding direction. The engaging slots in a same row are not offset relative to each other in said first sliding direction. The first engaging terminals 34 and the second engaging terminals 341 are alternately disposed in the rows of engaging slots 32 in said second direction. The contact sections 36 of the first and second engaging terminals 34, 341 in a same row of engaging slots are offset from each other in said first sliding direction.

Figure 5B:
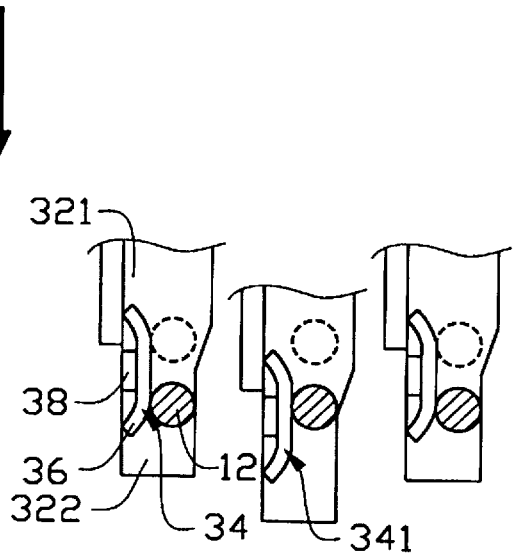
FIG. 5B is similar to FIG. 5A showing the engaging terminals engaged with the corresponding conductive terminals of the electronic package.

As shown in FIGS. 5A and 5B, adjacent rows of the engaging slots 32 are offset relative to each other along a first sliding direction as indicated by a large arrow. In this embodiment, the structures of the engaging terminals 34, 341 are identical, unlike in the first embodiment. When the conductive terminals 12 of the electronic package 10 are received in the wide openings 321 of the corresponding engaging slots 32 of the base 30, electrical contact is not yet established with the engaging terminals 34, 341. When the lever 26 is activated from a vertical position to a horizontal position to drive the cover 22 sliding along a top surface of the base 30 in the first sliding direction, the conductive terminals 12 are displaced from the wide openings 321 of the engaging slots 32 to the narrow openings 322 of the engaging slots 32, thereby contacting the corresponding contact sections 36 of the engaging terminals 34, 341. The supporting sections 38 of the engaging terminals 34, 341 are thus deformed toward a wall of the corresponding mating slot 32. The conductive terminals 12 firmly abut against a middle or end portion of the contact sections 36 thereby being distanced from the wide opening 321 of the mating slots 32. Therefore, electrical contacts between the conductive terminals 12 and the engaging terminals 34, 341 occurs at different times by alternately arranging adjacent rows of engaging slots 32 to be offset relative to each other along the first sliding direction of the relative sliding movement of the insulative cover 22 along the insulative base 30.

Figure 6B:
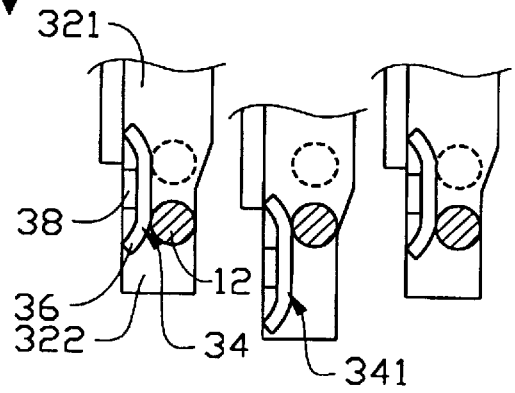
FIG. 6B is similar to FIG. 6A showing the engaging terminals engaged with the corresponding conductive terminals of the electronic package.

Referring to FIGS. 6A and 6B, in the third embodiment, the first engaging terminals 34 are offset relative to the second engaging terminals 341 as described in the first embodiment and adjacent rows of engaging slots 32 are offset relative to each other, both along a first sliding direction as indicated by a large arrow. As described in the second embodiment. In this embodiment, the mating process is similar to the mating process of the other two embodiments, hereon do not repeat it again.

In addition, the engaging terminals can consist of more than two different types. The position of each type of engaging terminal can be offset relative to the position of a different adjacent type of engaging terminal thereby providing sequential electrical contact between the conductive terminals 12 of the electronic package 10 and the engaging terminals of the same type thereby effectively dispersing the peak operative resistance of the socket 20.

Figure 7:
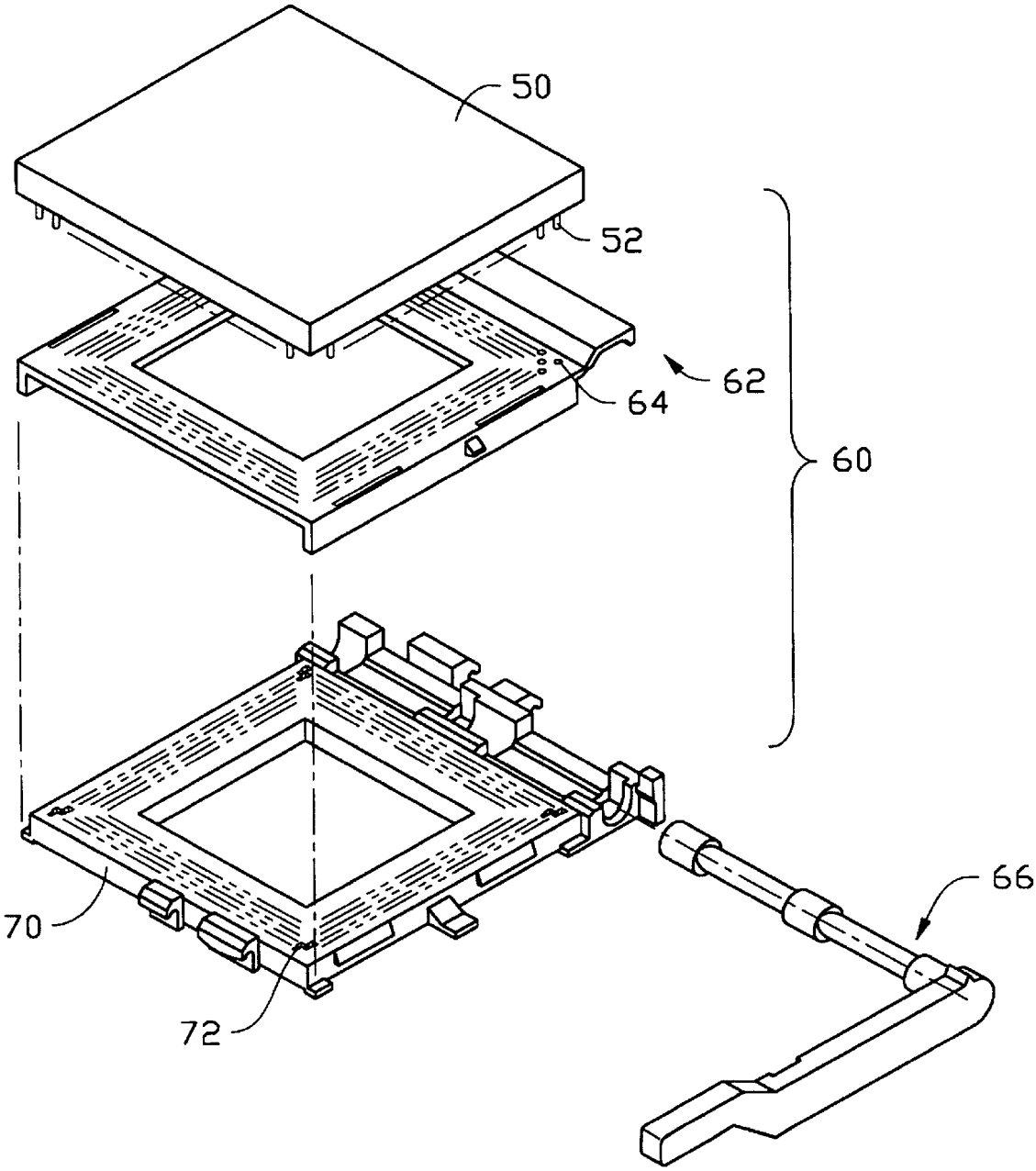
FIG. 7 is an exploded view of the present invention and an electronic package having alternately arranged rows of conductive terminals.

Furthermore, if conductive terminals 52 of an electronic package 50 are aligned, as shown in FIG. 7, then the same measures described in the disclosed embodiments can be used to create intervals during the assembly process of a socket 60 and the electronic package 50 thereby dispersing and reducing the operating resistance of the socket 60.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A zero insertion force socket for electrically connecting an electronic package with a mother board, said electronic package having a plurality of conductive terminals disposed in rows, the conductive terminals in a same row are not offset relative to each other in a predetermined direction, said socket comprising:

an insulative base defining a plurality of engaging slots therethrough arranged in an array;

an insulative cover operably mounted on the insulative base and being slidable along the insulative base in a first sliding direction defined by relative sliding movement between the insulative cover and the insulative base, and defining a plurality of terminal receiving passageways therein adapted for receiving conductive terminals of an electronic package therein; and a plurality of engaging terminals each being received in a corresponding engaging slot of the insulative base, the engaging terminals comprising at least first engaging terminals and second engaging terminals, each of the first and second engaging terminals having a contact section adapted for contacting a corresponding conductive terminal of the electronic package; wherein the array of engaging slots in the insulative base comprises at least one row extending in a second direction which is perpendicular to said first sliding direction, and wherein the adjacent engaging slots in said at least one row are not offset relative to each other in said first sliding direction, and wherein the first engaging terminals and the second engaging terminals are alternately disposed in the rows of engaging slots in said second direction, wherein the contact sections of the first and second engaging terminals in said at least one row of engaging slots are offset from each other.

2. The socket as claimed in claim 1, wherein positions of the first engaging terminals in the corresponding engaging slots are offset relative to positions of the second engaging terminals in the corresponding engaging slots along the direction of relative sliding movement between the insulative cover and the insulative base, and wherein rows of the engaging slots receiving the first engaging terminals are offset relative to rows of the engaging slots receiving the second engaging terminals along the direction of relative sliding movement between the insulative cover and the insulative base.

3. The socket as claimed in claim 1, wherein more than two different types of engaging terminals are arranged to be offset relative to each other along the direction of relative sliding movement between the insulative cover and the insulative base.

4. The socket as claimed in claim 1, wherein said package moves relative to the base along a direction parallel to the top surface of the base and parallel to a longitudinal axis of the engaging slots.

5. A zero insertion force socket assembly comprising:

an insulative base defining a plurality of engaging slots therethrough arranged in at least one row;

a plurality of engaging terminals received within the engaging slots of the base;

an electronic package including a plurality of conductive terminals engageable with corresponding engaging terminals, said package being relatively moveable with regard to the base along a first sliding direction defined by relative movement between the package and the base;

the engaging terminals comprising first type engaging terminals and second type engaging terminals alternatively disposed in said at least one row of the slots of the base in a second direction perpendicular to the first sliding direction, wherein said first type engaging terminals and said second type engaging terminals have contact sections which are offset different distances relative to the corresponding conductive terminals of the package along said first sliding direction so that when the conductive terminals relatively move toward and successively contact the respective corresponding engaging terminals, said first type engaging terminals are engaged by the corresponding conductive terminals before the second type engaging terminals are engaged by the corresponding conductive terminals.

* * * * *